US008549789B2

(12) United States Patent
Gore et al.

(10) Patent No.: US 8,549,789 B2
(45) Date of Patent: Oct. 8, 2013

(54) HIDDEN WINDOW RETAINER SYSTEM FOR DOORS

(75) Inventors: Sachin Gore, Des Moines, IA (US); Kelly Hemping, Altoona, IA (US)

(73) Assignee: Andersen Corporation, Bayport, MN (US)

( * ) Notice: Subject to any disclaimer, the term of this patent is extended or adjusted under 35 U.S.C. 154(b) by 151 days.

(21) Appl. No.: 11/506,654

(22) Filed: Aug. 18, 2006

(65) Prior Publication Data

US 2007/0089369 A1 Apr. 26, 2007

Related U.S. Application Data

(60) Provisional application No. 60/729,827, filed on Oct. 24, 2005.

(51) Int. Cl.
*E06B 7/28* (2006.01)

(52) U.S. Cl.
USPC ..... 49/169; 49/163; 49/463; 49/400; 49/62

(58) Field of Classification Search
USPC ..... 49/50, 54, 57, 70, 163, 169, 394, 400, 49/401, 463, 464–466, 62, 61, 63, 65, 67, 49/382; 160/90, 92, 95, 96, 116, 180; 70/107; 292/336.3, 347
See application file for complete search history.

(56) References Cited

U.S. PATENT DOCUMENTS

| | | | | | |
|---|---|---|---|---|---|
| 751,668 | A | * | 2/1904 | Moskow | 160/97 |
| 1,100,564 | A | * | 6/1914 | Heryford | 160/97 |
| 1,573,194 | A | * | 2/1926 | Roe | 160/91 |
| 1,589,496 | A | * | 6/1926 | Whalbe | 292/336.3 |
| 1,845,206 | A | * | 2/1932 | Snyder | 49/463 |
| 1,859,974 | A | * | 5/1932 | Kroenke | 160/97 |
| 1,903,309 | A | * | 4/1933 | Kelly | 160/95 |
| 1,954,640 | A | * | 4/1934 | Loper | 160/128 |
| 1,987,757 | A | * | 1/1935 | Snyder | 160/91 |
| 2,003,982 | A | | 6/1935 | Swanson | |
| 2,219,344 | A | * | 10/1940 | Taylor | 16/324 |
| 2,298,559 | A | * | 10/1942 | Fredholm | 292/5 |
| 2,511,108 | A | * | 6/1950 | Hansen | 160/90 |
| 2,537,896 | A | * | 1/1951 | Hinton et al. | 292/1 |
| 2,541,948 | A | * | 2/1951 | Swartswelter, Jr. | 49/463 |
| 2,568,130 | A | * | 9/1951 | Olson | 49/62 |
| 2,604,156 | A | * | 7/1952 | Lillethorup | 160/92 |
| 2,611,933 | A | * | 9/1952 | Comfort | 52/207 |
| 2,670,507 | A | | 3/1954 | Daitch et al. | |
| 3,065,624 | A | * | 11/1962 | Friedman | 70/153 |
| 3,226,776 | A | * | 1/1966 | Van Wormer | 49/70 |

(Continued)

OTHER PUBLICATIONS door. (n. d.) The American Heritage® Dictionary of the English Language, Fourth Edition. (2003). Retrieved Mar. 10, 2010 from http://www.thefreedictionary.com/door.*

*Primary Examiner* — Gregory J. Strimbu

(74) *Attorney, Agent, or Firm* — Womble Carlyle Sandridge & Rice, LLP

(57) ABSTRACT

A door has a frame forming an opening of the door, a window unit rotatably attached to the frame for positioning in the opening of the frame, a retainer moveably mounted on the frame, and an operator for operating the retainer. The retainer is moveable from a released position wherein the retainer is disengaged from the window unit, to a retaining position, wherein the retainer engages the window unit to hold the window unit in the opening.

10 Claims, 20 Drawing Sheets

(56) References Cited

U.S. PATENT DOCUMENTS

| | | | | | |
|---|---|---|---|---|---|
| 3,380,192 | A | * | 4/1968 | McKenna | 49/62 |
| 3,739,527 | A | * | 6/1973 | Schubach | 49/466 |
| 3,911,621 | A | * | 10/1975 | McHeffey | 49/192 |
| 4,074,462 | A | * | 2/1978 | McHeffey | 49/192 |
| 4,302,907 | A | * | 12/1981 | Canals et al. | 49/65 |
| 4,541,200 | A | * | 9/1985 | Gartner | 49/192 |
| 4,610,472 | A | | 9/1986 | Billingsley | |
| 4,799,330 | A | * | 1/1989 | Hudson | 49/62 |
| 4,803,808 | A | * | 2/1989 | Greisner | 49/394 |
| 4,912,877 | A | * | 4/1990 | Strydom | 49/171 |
| 4,991,886 | A | | 2/1991 | Nolte et al. | |
| 5,365,706 | A | * | 11/1994 | Elsenpeter et al. | 52/204.1 |
| 5,370,428 | A | | 12/1994 | Dreifert et al. | |
| 5,535,550 | A | * | 7/1996 | Yang | 49/163 |
| 5,553,420 | A | | 9/1996 | Klimek | |
| 5,653,485 | A | | 8/1997 | Campbell | |
| 5,730,477 | A | | 3/1998 | Nagy | |
| 5,742,978 | A | * | 4/1998 | Vetter | 16/220 |
| 5,813,710 | A | | 9/1998 | Anderson | |
| 5,927,767 | A | | 7/1999 | Smith et al. | |
| 6,109,668 | A | | 8/2000 | Demarco | |
| 6,161,881 | A | | 12/2000 | Babka et al. | |
| 6,230,457 | B1 | | 5/2001 | Brautigam | |
| 6,367,853 | B1 | | 4/2002 | Briggs | |
| 6,526,694 | B1 | * | 3/2003 | Cosgrove | 49/67 |
| 6,745,515 | B1 | * | 6/2004 | Chen | 49/169 |
| 7,350,555 | B2 | * | 4/2008 | Qing | 160/90 |

* cited by examiner

HIDDEN WINDOW RETAINER SYSTEM FOR DOORS

CROSS-REFERENCE TO RELATED APPLICATIONS

This application claims the benefit of U.S. Provisional Application No. 60/729,827, filed on Oct. 24, 2005, the entire contents of which are hereby incorporated by reference as if presented herein in their entirety.

TECHNICAL FIELD

This invention relates generally to doors and more particularly to storm doors with glass window units.

BACKGROUND

Doors having glass window units incorporated into them find many applications, such as, for example, as storm doors in residential dwellings. It is desirable, from time to time, to convert storm doors to screen doors by removing the glass window unit from the door and replacing it with a screen unit. It may also be necessary, on occasion, to replace a damaged window unit with an undamaged or otherwise different window unit. When the window units are large, they can be quite heavy, thereby making such replacements burdensome. In addition, fastening or retaining devices that are sufficiently robust to hold large window units in place often require special tools to perform the removal and replacement operation. It is also desirable for window unit fastening and retaining devices to be as unobtrusive as possible, so as to allow the most aesthetically pleasing door designs to be used.

There is therefore a need for a storm door with a window unit that can be installed by a simple positioning and retaining or latching operation, without the need for tools during the operation. There is also a need for a window retaining system capable of easily securing large window units in a storm door without diminishing the overall aesthetics of the door. It is to the provision of such a storm door and retaining system that the present invention is primarily directed.

SUMMARY OF THE INVENTION

Briefly described, the present invention comprises a door, and particularly a storm door, having a removable window unit that can easily be installed and removed without the use of tools. Installation entails positioning and retaining tasks that are performed in sequence, without the need to perform positioning and retaining simultaneously. The window unit is installed by positioning a first edge of the window unit in an opening of the door along one side, rotating the window unit about the first edge into its final position spanning the opening in the door, and securing the window panel in place with a retaining mechanism built into the door and operated by a handle. In one embodiment, the window unit retaining mechanism is incorporated into the door latch system so that the same handle is used for securing the window unit in position and routine opening and closing of the door. In some embodiments, a safety catch is provided to prevent accidental release of the window panel from the door during normal operation.

In the disclosures provided herein, the terms horizontal and vertical are with reference to the drawings, and do not limit the orientation of components in actual doors or windows. For example, the first edge holder, shown as vertically oriented in the drawings, could also be horizontally oriented at the bottom edge of the window unit, with the second edge holder at the top horizontal edge of the window unit.

Additional feature, objects, and advantages of the invention will become more apparent upon review of the detailed description set forth below taken in conjunction with the attached drawing figures, which are briefly described as follows.

BRIEF DESCRIPTION OF DRAWINGS

Corresponding parts are designated by corresponding reference numbers throughout the drawings.

DETAILED DESCRIPTION

Figure 1:
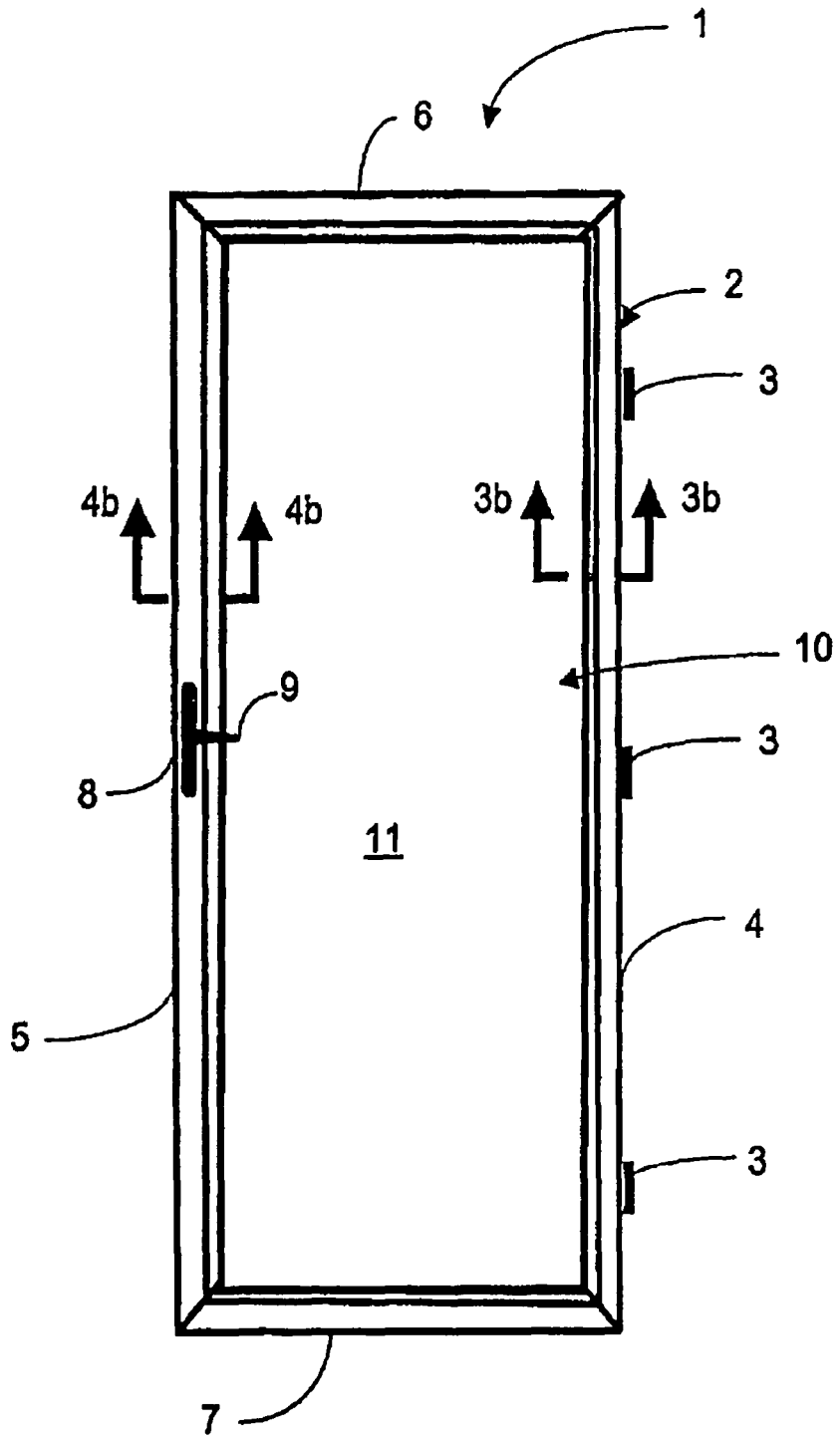
FIG. 1 is a plan view of a door of the present invention including a window unit in an installed position on the door.

Referring now in more detail to the drawings, wherein like reference numerals refer, where appropriate, to like parts throughout the several views, FIG. 1 illustrates a door 1 that is made up of frame 2 that surrounds and supports a window unit 10. Frame 2 is made up of hinge stile 4, lock stile 5, top rail 6, and bottom rail 7. Top rail 6 connects the top ends of hinge stile 4 and lock stile 5, while bottom rail 7 connects the bottom ends of hinge stile 4 and lock stile 5 to form a complete frame around window unit 10. Consistent with conventional usage, the term stile will refer to a vertical member, and the term rail will refer to a horizontal member. Door 1 also includes latch and lock assembly 8 that is operated by handle 9. Door 1 is mounted in a door frame (broadly "support frame"), not shown, by hinges 3, attached to hinge stile 4 and to a vertical jamb portion of the door frame, also not shown. The door 1 can thus be opened and closed in the traditional manner.

The rails and stiles 4, 5, 6, and 7 can be produced from a continuously formed stock material, such as aluminum or other metal, or from polymeric or plastic materials. Continuous forming methods may include extrusion and roll forming. The stock material is cut to the lengths needed to form frame 2. These cut lengths of stock material are called lineals. The ends of the lineals can be shaped, or end fabricated, in a manner that enables them to fit together to produce the frame 2. A useful end fabrication is a 45° angle that allows the members to fit together to form 90° mitered corners, as shown in FIG. 1. It has been recognized that using the same stock material for the stiles and rails 4-7 simplifies production and provides a pleasing appearance to the door, but that this uniformity may limit the ability of the different members to perform the different functions required of them. Embodiments of the present invention therefore include features for receiving other, secondary parts that adapt one or more of lineals 4-7 to specific functions that they may need to serve, such as initially receiving window unit 10, retaining it in place after installation, and allowing removal of the window unit with a reasonable effort, as detailed below. In the embodiments disclosed herein, this has been accomplished by producing a primary lineal profile that performs the functions common to lineals 4-7, but with provisions for attaching secondary parts adapted to the particular functions that each stile or rail performs. The secondary parts also may be lineals, but can also be individual piece parts.

Figure 2:
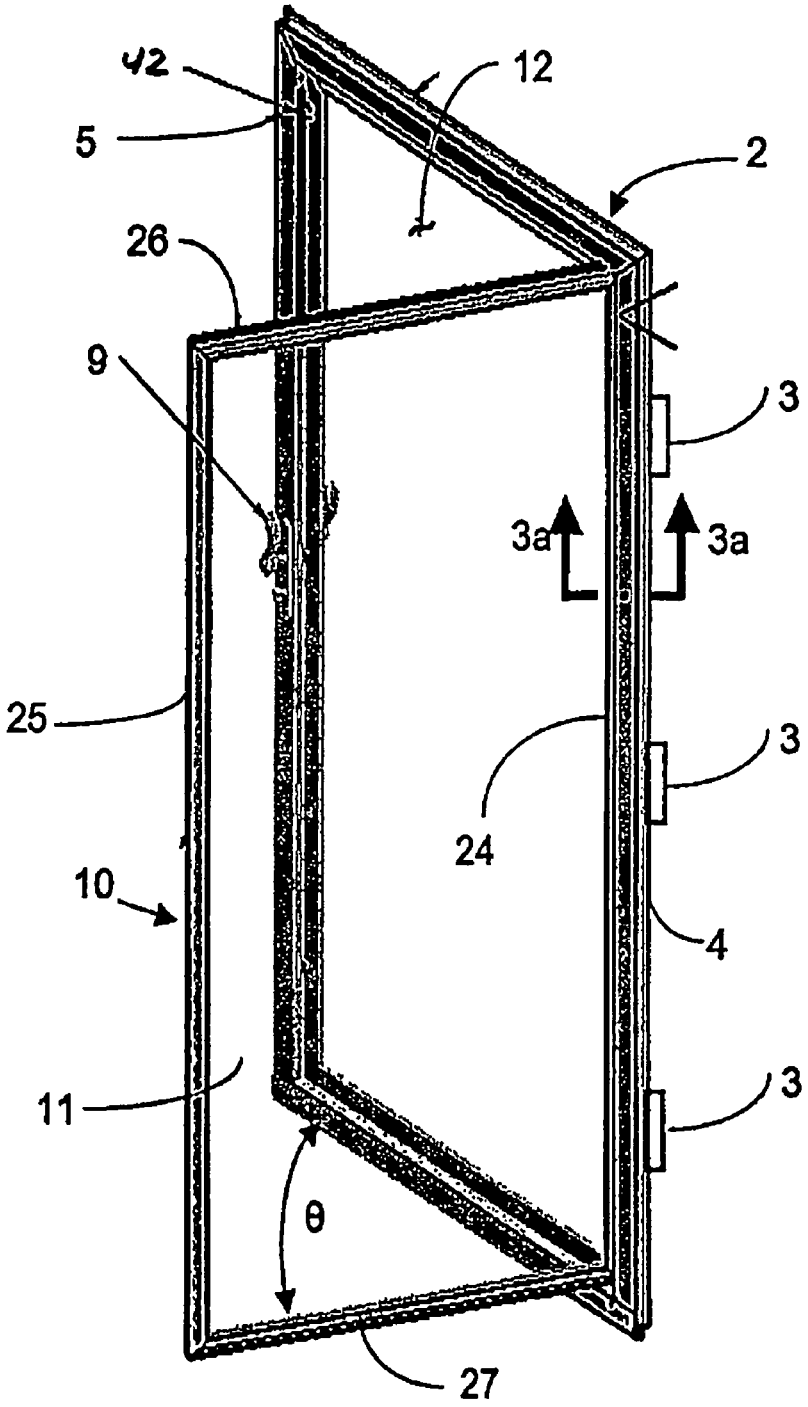
FIG. 2 is a perspective view of the door with the window unit in an intermediate position during the installation process.

Referring to FIG. 2, window unit 10 can be installed and removed without tools, and without the difficult challenge of positioning the window unit 10 and simultaneously locking it in place. In FIG. 2, hinge stile 4 is adapted to receive first vertical frame member 24 of window unit 10 when the window unit 10 is inserted at an angle θ to the plane of door frame 2. The receiving portion of hinge stile 4 thus serves as a first edge holder for a first edge of window unit 10. Angle θ can be any convenient nonzero angle, though angles less than 90° are preferred. After the first vertical frame member 24 is received by hinge stile 4, the window unit 10 is rotated toward door frame 2 in the direction of arrow 100 (FIG. 3*a*), thereby progressively reducing angle θ to 0. At this position, second vertical frame member 25 engages lock stile 5, so that the portion of stile 5 that engages the second edge of window unit 10 serves as a second edge holder for the window unit. A final step in the window unit installation process is to lock window unit 10 in place using a retaining mechanism provided in lock stile 5. In one embodiment of the invention, the retaining mechanism is operated by handle 9, which also serves the traditional purpose of latching and unlatching door 1. A safety catch can be provided to allow unlocking of the window unit retaining mechanism only when the safety catch is moved to a release position. This prevents accidental unlocking of the window unit during normal operation of the door.

Figure 3A:
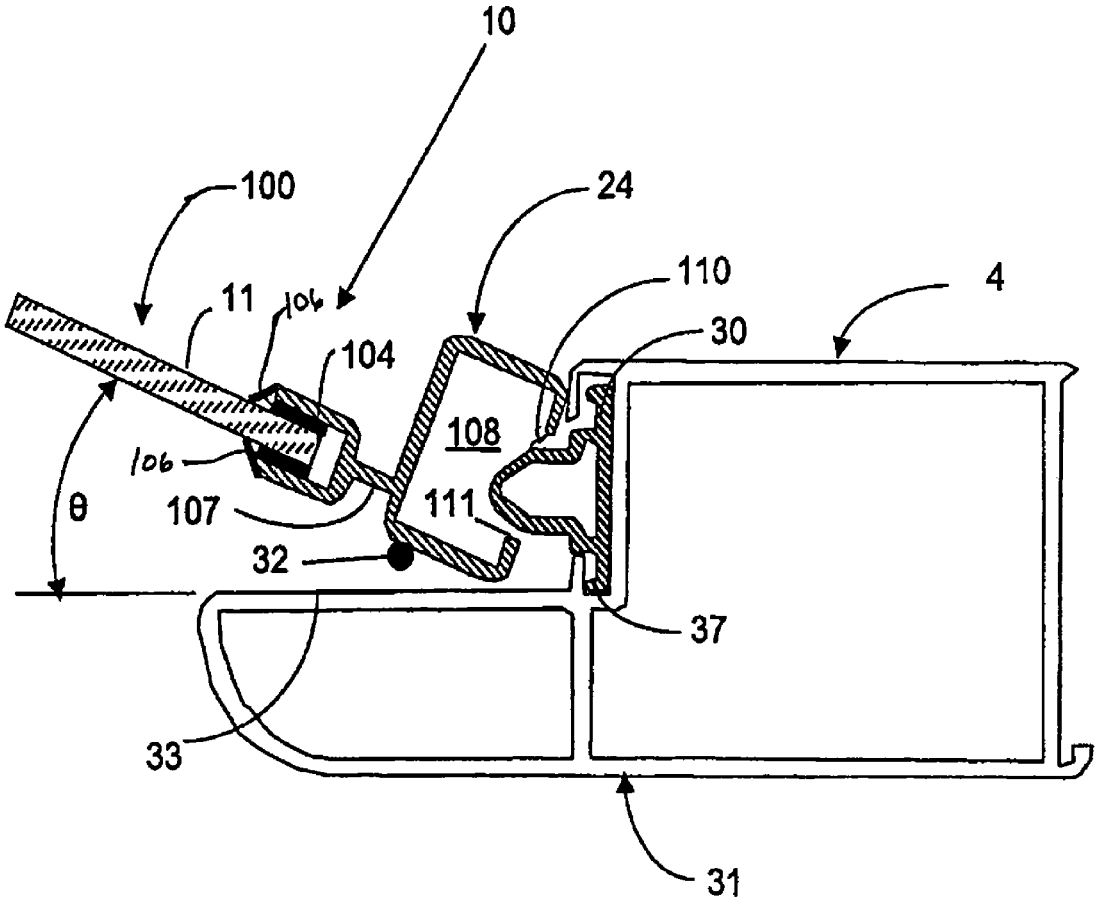
FIG. 3*a* is a partial cross-section of the door taken along the plane 3*a*-3*a* of FIG. 2 showing a first edge holder receiving a first edge of the window unit.

FIG. 3*a* shows in more detail the window unit 10 being received by a first edge holder portion of hinge stile 4. Hinge stile 4 comprises primary lineal 31 and snugger 30. Snugger 30, which fits into channel 37 of the lineal, can be an extruded part, made, for example, from as PVC or other polymeric material. It is preferred that snugger 30 be somewhat resilient so as to act as a spring to urge a gasket 32 of window unit 10 firmly against sealing surface 33 of stile 4. In this way, snugger 30 and sealing surface 33 act as a first edge holder for window unit 10 and ensure a tight seal.

Alternative embodiments of the first edge holder are possible. For example, the snugging function could be performed by structures other than snugger 30. More particularly, rather than using a continuously extruded snugger, individual spaced apart piece parts can be attached to primary lineal 31 to receive first frame member 24 of window unit 10. Snugger 30 also can be replaced by pins or other like devices that fit into gap 110 of frame member 24. Similarly, snugger engaging channel 108 and continuous gap 110 can be replaced by individual holes or other receiving apertures. Snugger 30 need not be a continuous part, but can comprise shorter lineal sections spaced intermittently along primary lineal 31.

While it is convenient to place the first edge holder in hinge stile 4, it also is possible to reverse the direction of installation of the window unit by placing the first edge holder in lock stile 5 and the second edge holder in hinge stile 4. More specifically, snugger 30, or other components performing the snugging function, can be installed in lock stile 5, and lock bar 42, or other components performing the retaining function, can be installed in hinge stile 4. Operation of the second edge holder, whether lock bar or other retaining device, can be performed by an operating handle, knob, lever, or other like device located in hinge stile 4, or by a device coupled to the latch mechanism through a linkage extending, for example, across the top or bottom of the door. Placing the first edge holder in lock stile 5 allows for installing and removing the window unit without the need to move the door handle to a particular position for installation and removal of the window unit.

Figure 3B:
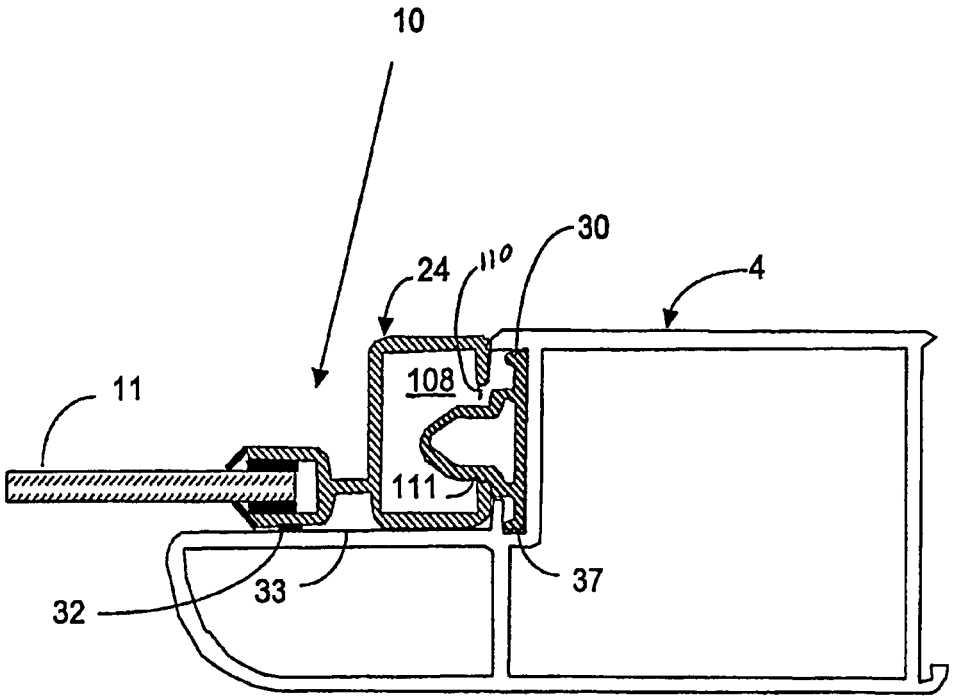
FIG. 3*b* is a partial cross-section of the door taken along the plane 3*b*-3*b* of FIG. 1.

Window unit frame members 24, 25, 26, and 27 preferably are made of a metal such as extruded aluminum or roll formed steel. For simplicity of manufacture and use, it is useful for all of the frame members to have the same cross sectional profile, so that they can be made from a single stock material cut into appropriate lengths, with end fabrication adapted to fit them together into a complete frame. In the embodiment shown in FIG. 3*a*, the cross sectional profile of window unit frame members 24-27 forms a glazing channel 104, a linking section 107, and a snugger engaging channel 108. Channel 108 further comprises snugger gap 110 that fits over snugger 30. Window unit frame member 24 further comprises gasket 32, which is a compliant sealing material attached to member 24 so as to seal against surface 33 when window unit 10 is fully installed. Glazing 11 can be sealed to channel 104 by commonly known sealants 106 such as silicone RTV or other suitable weatherproof sealing materials of the type known to those skilled in the art. FIG. 3*b* shows window unit 10 in its fully installed position in the door, with gap edge 111 fitting against snugger 30 to hold gasket 32 of window unit 10 firmly compressed against sealing surface 33.

Material suitable for the glazing 11 is not particularly limited. Glazing 11 may be a single pane, as shown in FIGS. 3*a* and 3*b*, or may be an insulated dual or multiple pane glazing unit, of the type well known in the fenestration art. Glazing 11 may be made of glass, transparent polymeric materials, or combinations thereof. Glazing 11 may, for example, be laminated safety glass. Glazing 11 may also incorporate etched, colored, or otherwise patterned or decorative glass. The ease of changing window units provided by the present invention allows window units of different appearances to be easily substituted, thereby allowing the appearance of the door to be easily changed, to reflect, for example, different seasons or holidays.

Figure 4A:
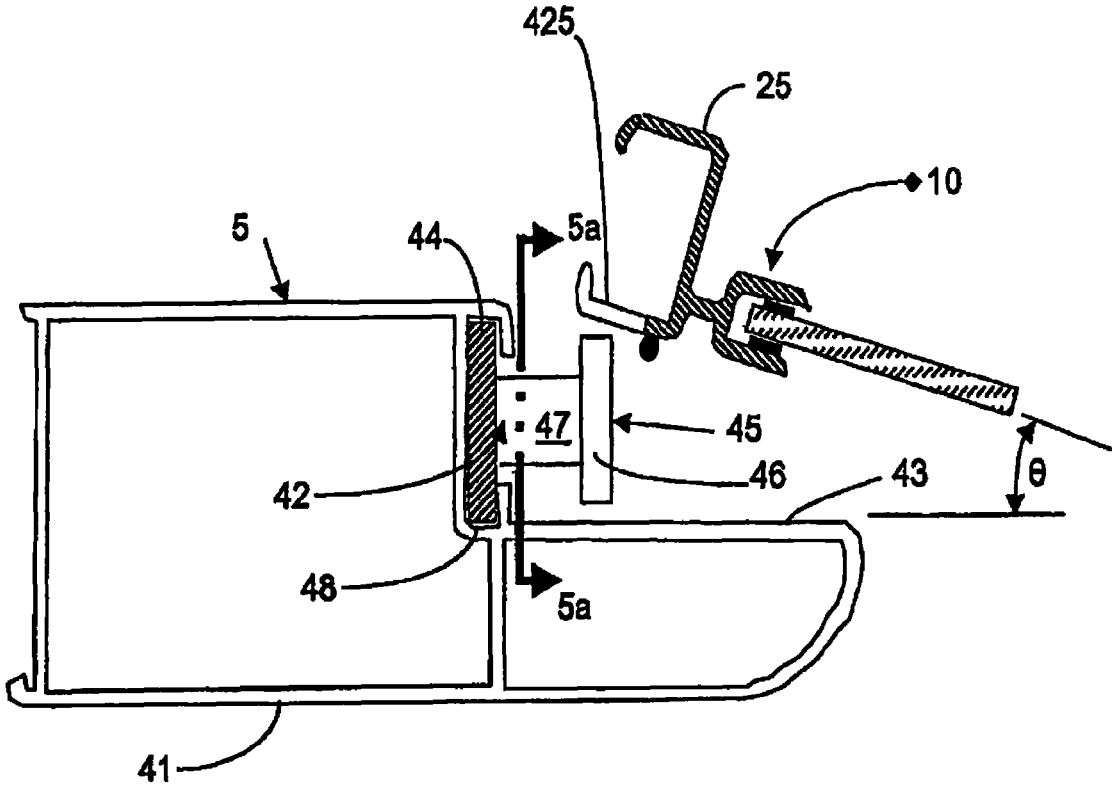
FIG. 4*a* is a partial cross-section of the door with the window unit positioned just prior to engagement of a second edge holder with a second edge of the window unit.
Figure 4B:
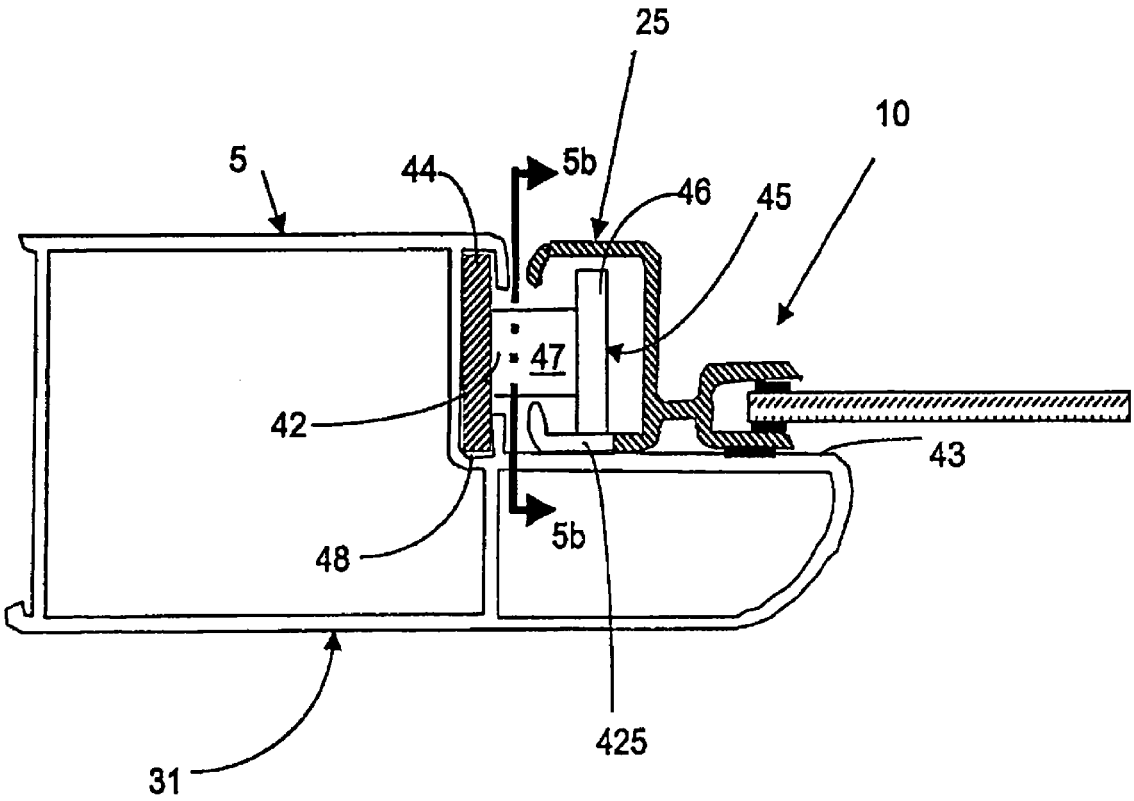
FIG. 4*b* is a partial cross-section of the door taken along the plane 4*b*-4*b* of FIG. 1.

FIG. 4*a* shows, in cross section, second vertical member 25 of window unit 10 just prior to engagement with a window sealing surface 43 of the frame member 5. FIG. 4*b* shows window unit 10 after completion of the insertion, held in the fully installed position by lock bar 42. Lock bar (broadly "retainer") 42 comprises slide bar 44, from which project lock pins 45. Lock pins 45 have shafts 47 and heads 46. Lock bar 42 slides vertically in channel 48. In a preferred embodiment, lock stile 5 comprises primary lineal 41 having the same cross sectional profile as primary lineal 31 of hinge stile 4, so that primary lineal 41 can be made from the same lineal stock as primary lineal 31, and channel 48 is identical to channel 37. It is understood that the lock bar 42 is received in channel 48 and is substantially hidden from view by the primary lineal 41 when the door 1 is viewed from the front (FIG. 1).

Figure 5A:
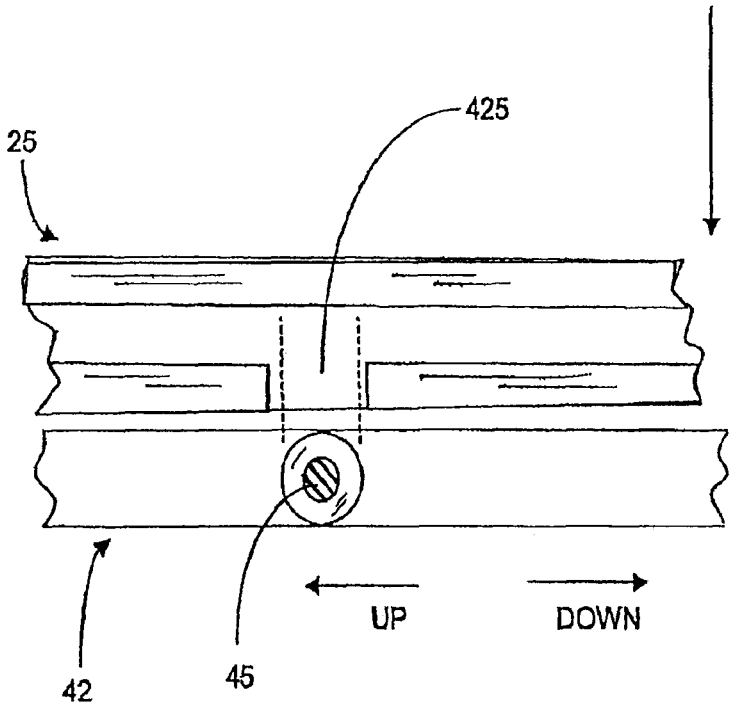
FIG. 5*a* is a partial cross-section of the door taken along the plane 5*a*-5*a* of FIG. 4*a*.
Figure 5B:
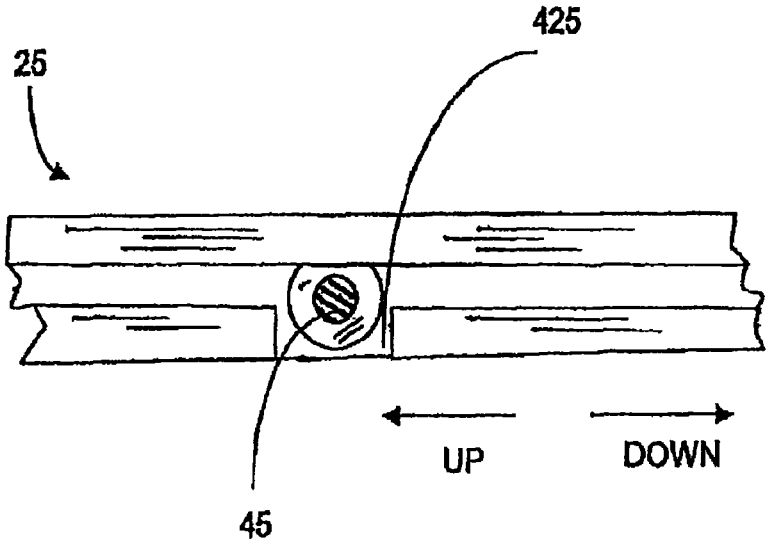
FIG. 5*b* is a partial cross-section of the door taken along the plane 5*b*-5*b* of FIG. 4*b*.
Figure 5C:
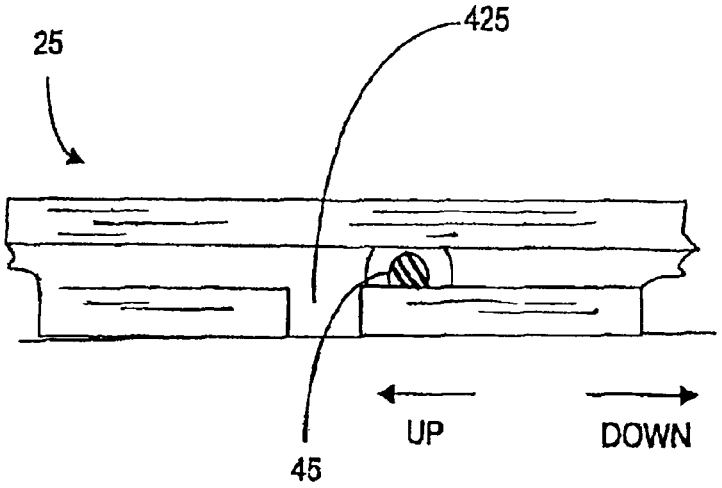
FIG. 5*c* is a partial cross-section similar to FIG. 5*b* but showing a window unit retainer in the retaining position.

FIGS. 5*a*-5*c* show the operation of lock bar 42 in more detail. Window unit frame member 25 is provided with at least one, and preferably several, installation notches 425, which allow insertion of window unit 10 over lock pins 45 into opening 12 of door 1. FIGS. 4*b* and 5*b* show the position of window unit frame member 25 relative to lock pins 45 after completion of the insertion step. Referring to FIG. 5*c*, after complete insertion, lock bar 42 is moved downward, so that lock pin 45 moves past notch 425, thereby locking window unit 10 in place. Removal of window unit 10 is the reverse of installation.

Operation of lock bar 42, that is to say the task of sliding lock bar 42 up and down for removal and installation of window unit 10, can be accomplished in a variety of ways. For example, a knob or other handle can be attached to the lock bar and a slot can be provided in lock stile 5 at a suitable exterior location. Alternatively, a lever mechanism of one of the types commonly found in casement window locks can be provided in lock stile 5. Rack and pinion mechanisms also might be used for raising and lowering the lock bar 42. It also is useful, for some types of operating mechanisms, to provide a safety catch or interlock to prevent accidental release of the window unit without first releasing the safety catch.

Particularly useful devices for raising and lowering lock bar 42 are those that are incorporated into the door latching mechanism, so that a single handle, namely the door handle used to unlatch and open the door, also is used to retain and release the window unit. By incorporating these functions into a single handle, the overall construction of the mechanism can be simplified, and the appearance of the door can be improved.

Figure 6:
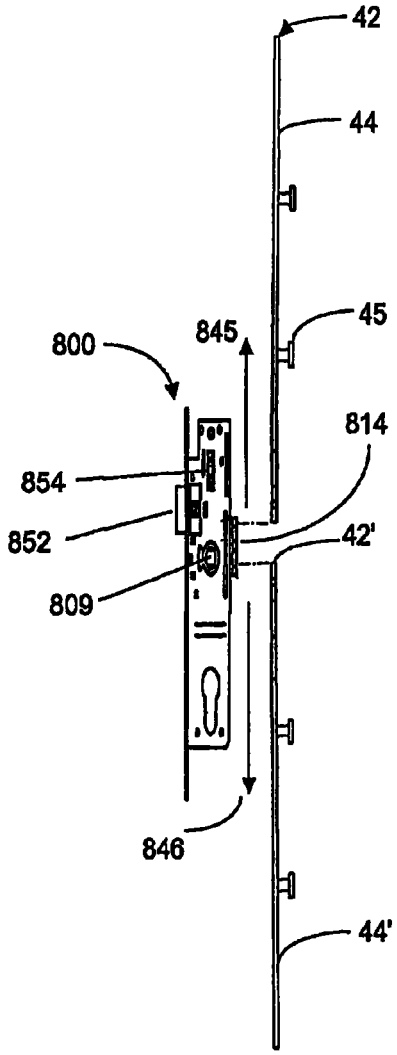
FIG. 6 is a partial side elevation of the door showing a lock assembly with upper and lower lock bars removed from the lock assembly.
Figure 7:
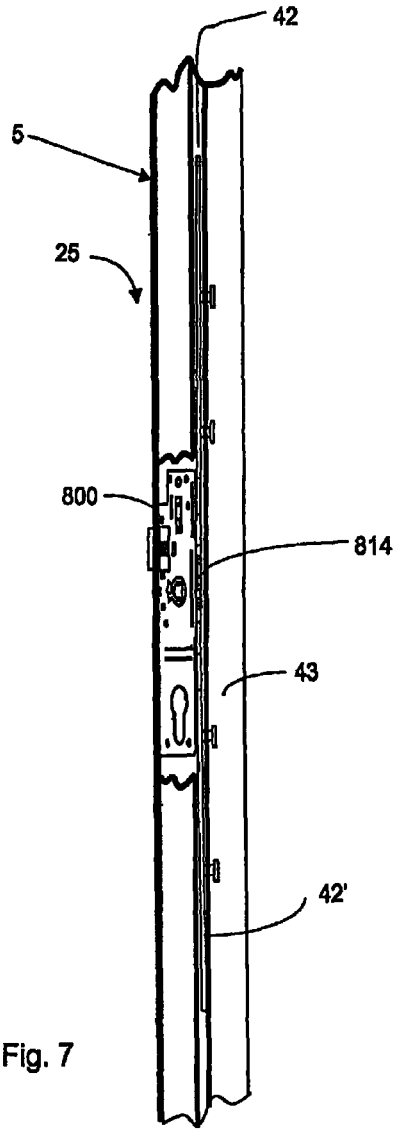
FIG. 7 is a view similar to FIG. 6 but showing the upper and lower lock bars attached to the lock assembly.

Lock bar 42 may be a single bar, or formed with upper and lower bars 42 and 42', as shown in FIG. 6. In one embodiment of the present invention, the one or more lock bars are slid up and down by a mechanism contained in the lock assembly for the door. Referring to FIG. 6, lock bars 42 and 42' are shown ready to be attached to lock bar coupling 814, which is part of door lock assembly 800. In operation, coupling 814 slides upward, in direction 845, for unlocking window unit 10 for removal, and downward, in direction 846, for locking the window unit in place after installation. FIG. 7 shows lock bars 42 and 42' installed, along with lock assembly 800, in lock stile 5. This installation can be carried out by first installing lock bars 42 and 42' in channel 48 of lock stile 5 (FIGS. 4*a*, 4*b*), by sliding them in from the ends of lock stile 5, then assembling frame 2, and finally installing the lock assembly. By appropriate choice of dimensions for the lock assembly relative to the dimensions of lock stile 5, lock bar coupling 814 can be made to couple with lock bars 42 and 42' simply as the result of the installation of lock assembly 800 in lock stile 5.

Figure 8:
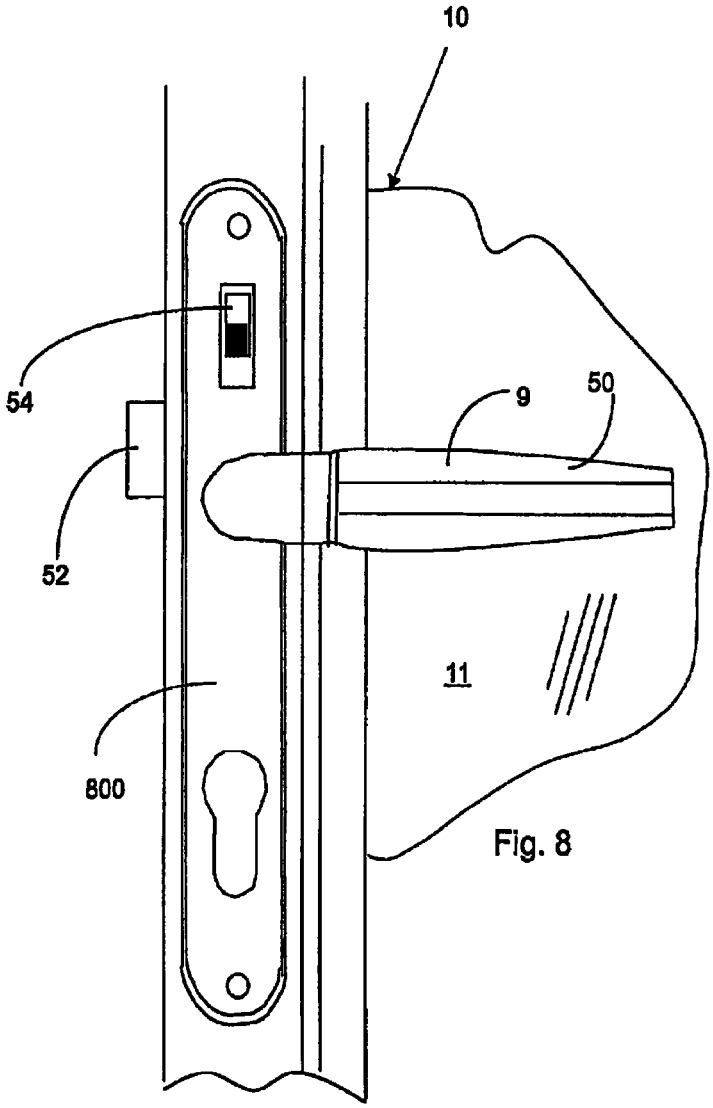
FIG. 8 is an enlarged partial elevation of the door with a handle of the lock assembly in an installed position.

By coupling the door latching function and the lock bar operating function in this way, an additional problem occurring in removable window units in doors is solved. In particular, certain popular types of door handles overlie and obstruct the path of the window unit during removal and installation in the door. Referring to FIG. 8, handle 9 is shown in its first, or neutral position, wherein latch 52 is extended for locking the door 1, and window unit 10 is locked in place in its installed position. It is apparent that handle 9 is in a position to obstruct removal of window unit 10 from frame 2 when in first position 50.

Figure 9:
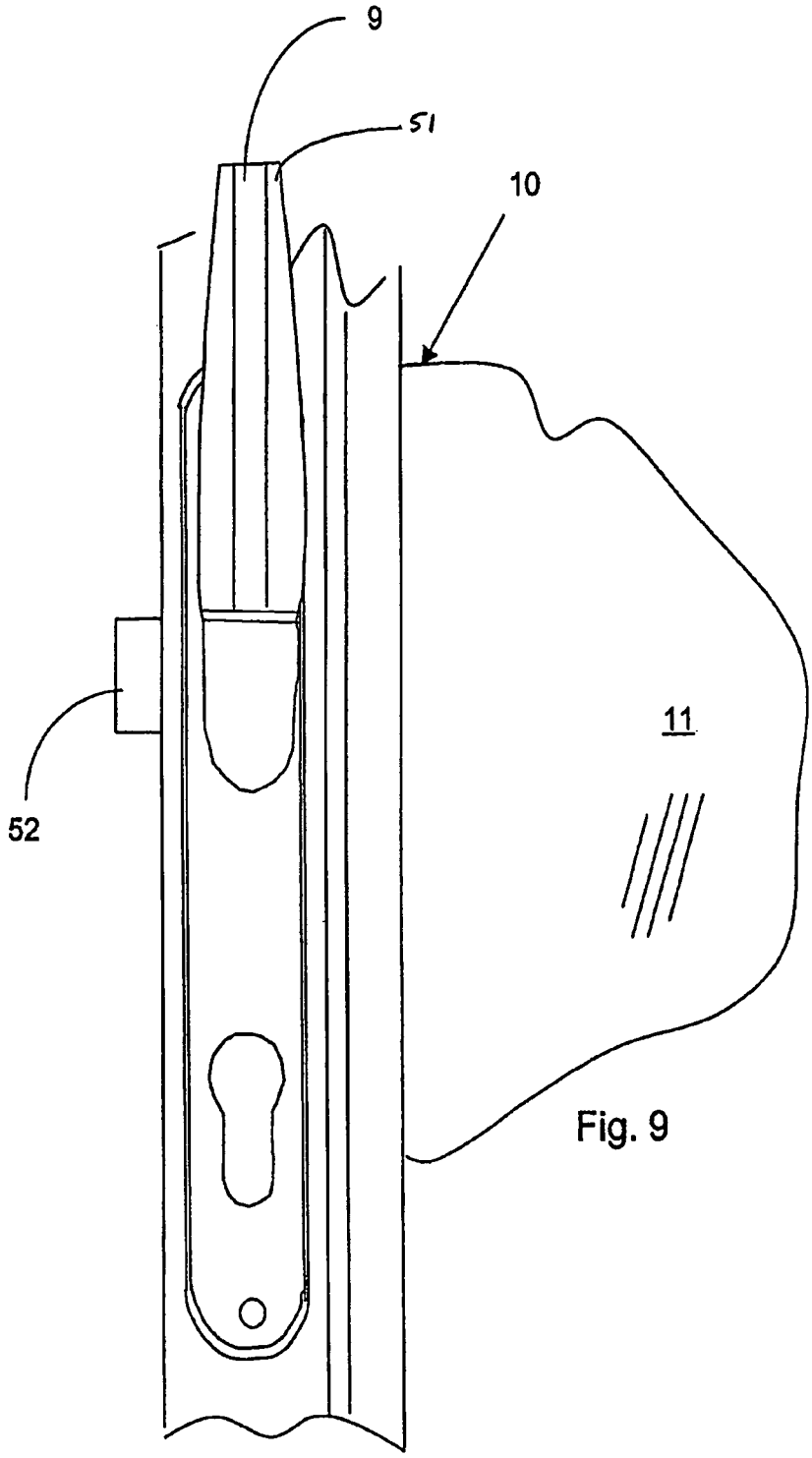
FIG. 9 is a view similar to FIG. 8 but with the handle in a release position.
Figure 10:
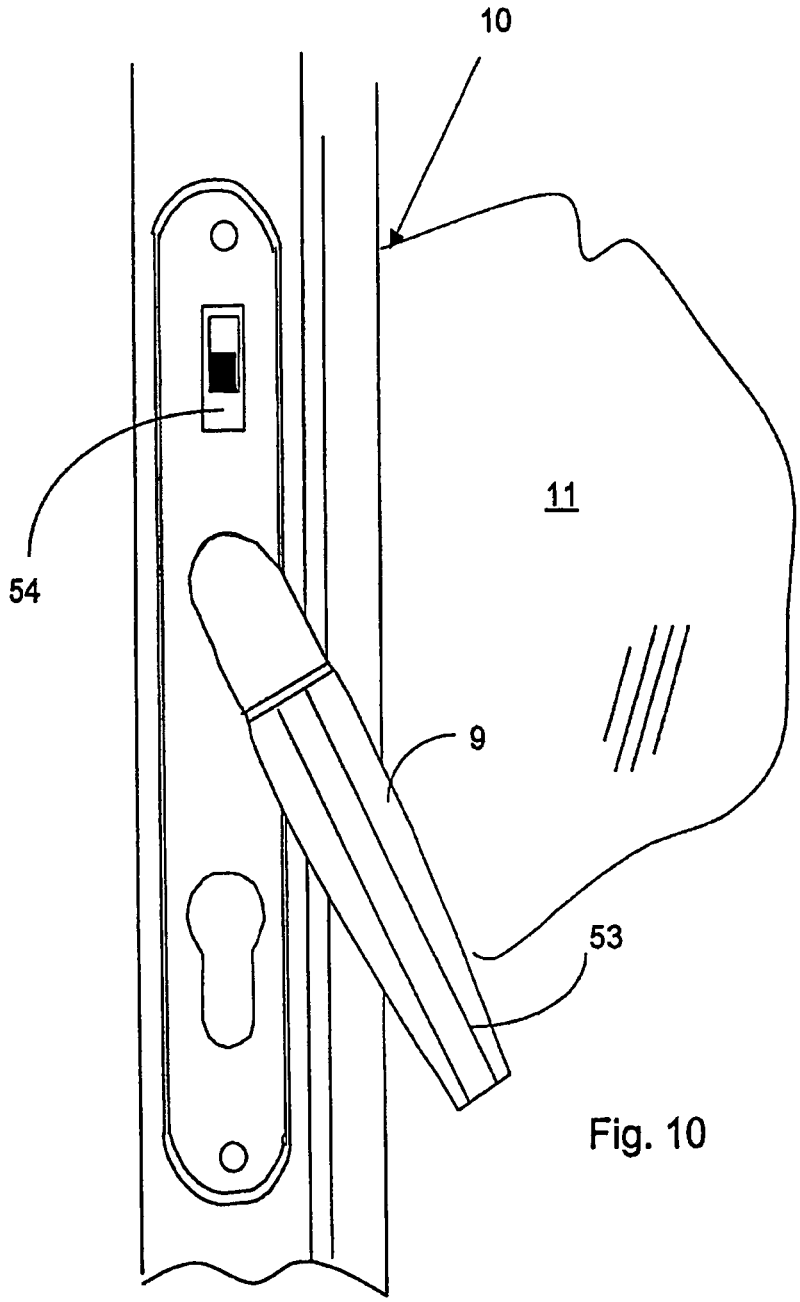
FIG. 10 is a view similar to FIG. 8 but with the handle in a door unlatching position.

Referring to FIG. 9, safety catch 54, hidden from view by handle 9, has been moved to its release position, thereby allowing handle 9 to be rotated upward to position 51. Door lock mechanism 800 incorporates a linkage that slides lock bar 42 upward, to unlock window unit 10 from door 1 when handle 9 is moved upward to position 51, where it is held by a mechanical detent. Window unit 10 can then be removed from door opening 12 without obstruction by handle 9. After reinstallation of the window or other unit, for example an insect screen unit, hand pressure on handle 9 overrides the mechanical detent and rotates it back down to first position 50, thereby locking the window or screen unit in place. At the same time, safety catch 54 snaps back to its safety locking position, once again preventing handle 9 from being accidentally rotated to the window releasing position. Referring to FIG. 10, handle 9 is, however, free to be rotated downward, to position 53, which is the third, or door unlatching position wherein latch 52 is withdrawn for unlocking the door 1. The door is thus ready for normal operation.

Other sequences of operating handle 9 are also possible. For example, the latch assembly can be configured to unlatch door 1 when handle 9 is rotated downward 45°, whereupon the safety catch is released and handle 9 is rotated another 45° to release window unit 10 for removal.

Figure 11:
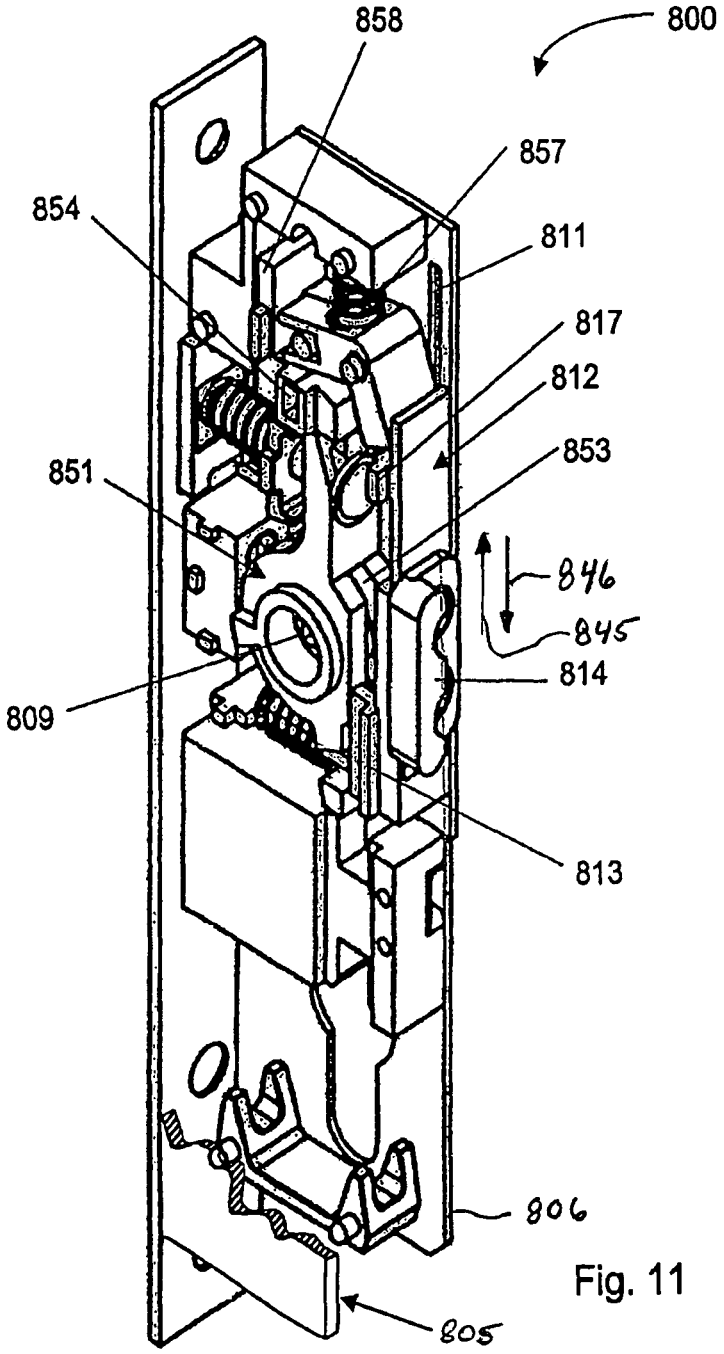
FIG. 11 is a partial perspective of the door lock assembly.
Figure 12:
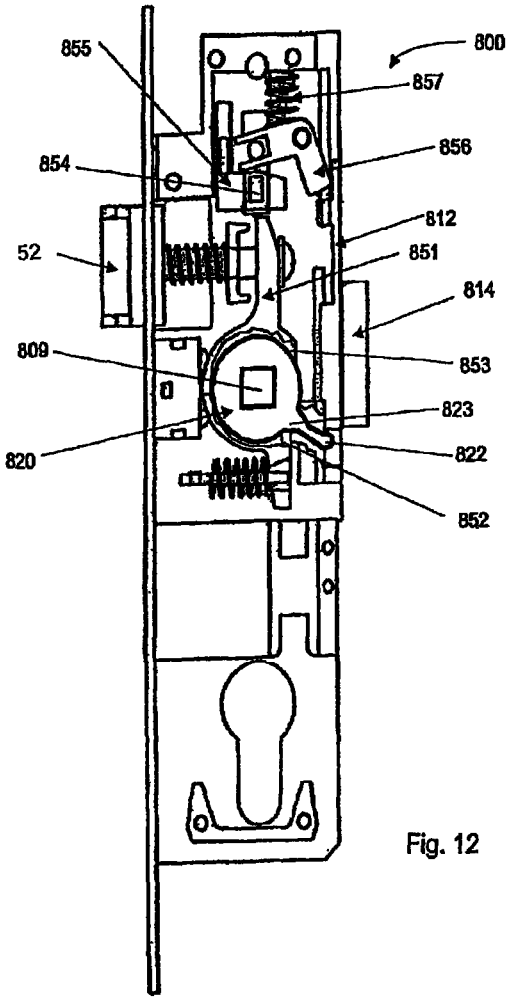
FIG. 12 is a partial elevation of the door lock assembly.

One embodiment of a mechanism by which lock assembly 800 operates lock bar coupling 814 is shown in FIGS. 11 and 12. In FIG. 11, lock bar coupling 814 is attached to lifting slide 812. Slide 812 is guided in its up and down movement by ribs such as ribs 813 and 817, which fit into slots in first side plate 805, shown in fragmentary view, and slots such as slot 811 in second side plate 806. Referring to FIG. 12, slide 812 is lifted by lift arm portion 822 of rotor 820 contained in slot 853 of latch operator 851. Rotor 820 is rotated by an operating shaft connected to the handle 9 (FIGS. 8-10) that is received by aperture 809 in a rotationally coupled manner. It will be appreciated that while aperture 809 is portrayed as being square in shape, other shapes for aperture 809 and for the operating shaft are also possible, provided the operating shaft is rotationally coupled to rotor 820. When rotor 820 is turned counterclockwise, as it is when the handle 9 is moved upward, lift arm 822 urges slide 812 upward, thereby lifting coupling 814 and the one or more lock bars 42, 42' (FIGS. 6-7) which are coupled thereto. Since rotor 820 is loosely fitted in slot 853, it is free to rotate in the counterclockwise, or lifting, direction, without affecting the position of latch operator 851. When rotor 820 is rotated in the clockwise direction, arm 822 is free to move downward, away from its contact surface on slide 812, but latch operator drive portion 823 of rotor 820 presses against stop 852 of latch operator 851, thereby rotating it in a clockwise direction to retract latch 52 and unlatch door 1.

For slide 812 to slide upward a sufficient distance to release lock bar 42, however, safety detent arm 856, which is held in a position to stop movement of slide 812 by spring 857, must be retracted. This is accomplished by moving safety detent slide 855 upward, thereby rotating arm 856 clockwise. Slot 854 is the safety catch receiver. It receives a protrusion from safety catch 54, shown in FIG. 9, which enables slide 855 to be moved upward when catch 54 is moved upward, thereby rotating detent arm 856 clockwise and allowing lifting slide 812 to move upward, carrying with it coupling 814 and lock bar 42 and releasing window unit 10 for removal.

An additional advantage of incorporating the window unit locking and unlocking function into the door latching handle is a reduction in the cluttered or busy appearance of the door that might result from additional handles, knobs, or other operating features necessary for the operation of the window unit retainer system.

Figure 13:
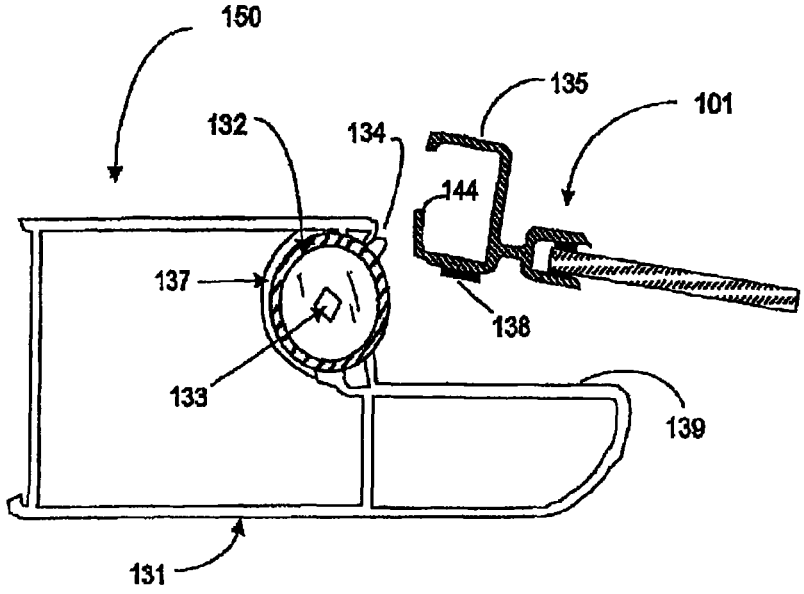
FIG. 13 is a partial cross-section of a door of a second embodiment with a window unit approaching a lock stile of the door.
Figure 14:
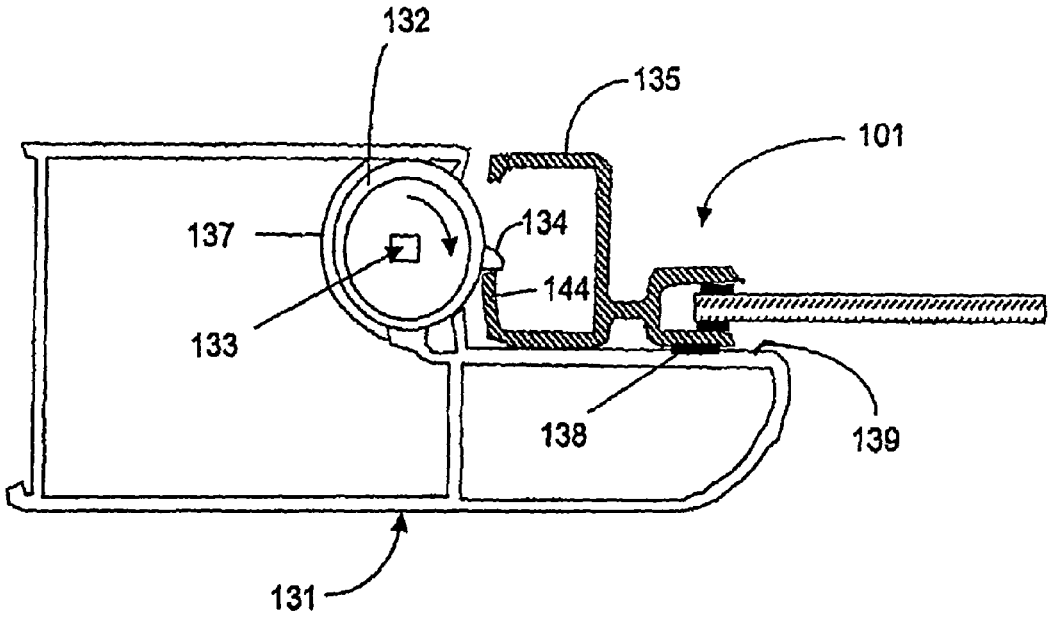
FIG. 14 is a partial cross-section of the door of the second embodiment with the window unit locked in place.

Other possible embodiments of the window unit retainer system utilize a rotating retainer rather than the sliding lock bar. Referring to FIGS. 13 and 14, window unit 101, having frame member 135 is shown approaching lock stile 150. Lock stile 150 comprises primary lineal 131 and cylindrical retainer 132, which fits into tubular portion 137 of primary lineal 131. Coupling 133 enables retainer 132 to be rotated from the release position, shown in FIG. 13, to the locked position, shown in FIG. 14, wherein spur portion 134 on retainer 132 presses against rib 144 of frame member 135, to hold window unit 101 in place. It will be appreciated that while rib 134 is portrayed as a continuous rib, it need not be limited to this configuration. Discontinuous projections, either integrally formed with retainer 132 or attached as separate parts could also be used. Retainer 132 may be a single part, or may be provided in sections, of any suitable size an number, coupled together, for example, by a central shaft.

Operating mechanisms for rotating and holding retainer 132 in the locked position are not particularly limited, although mechanisms that are simple to operate, that do not require tools, and that do not detract from the appearance of the door are particularly preferred. Also useful are mechanisms that provide a predetermined level of torque to retainer 132, so as to hold gasket 138 of window unit 101 firmly sealed against sealing surface 139, without causing damage due to excessive torque. One example of a useful operating mechanism is a retractable lever fitting into a channel in the top edge of the door and engaging coupling 133.

Figure 15:
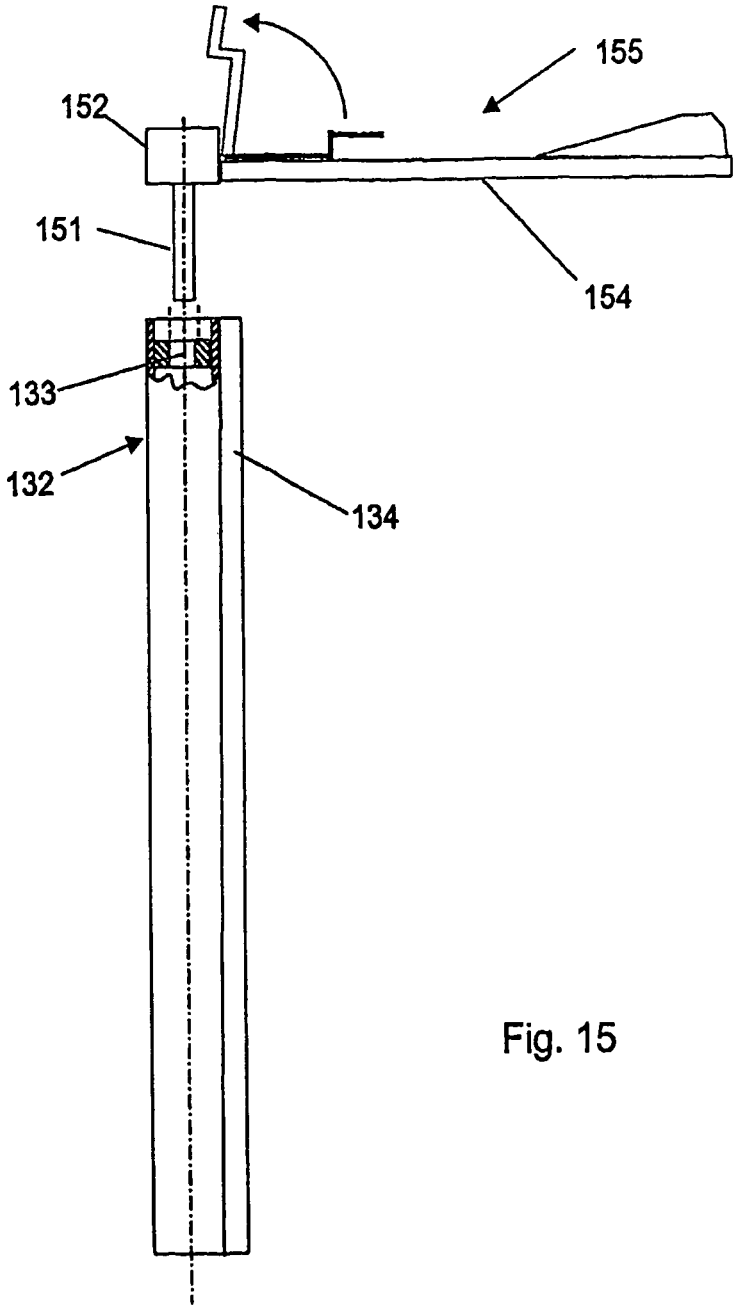
FIG. 15 is a partial cross-section of a retainer and a retainer operator of the second embodiment.

Referring to FIG. 15, retainer operator 155 is a torque wrench-like device having a coupling shaft 151 that engages coupling 133. Shaft 151 is coupled to handle 154 through head 152. Head 152 can contain springs or other force controlling devices, of the type commonly found in torque wrenches, to provide a calibrated relation between the movement of handle 154 relative to head 152 and the amount of torque applied to coupling 133 by shaft 151. It may also be useful to incorporate a predetermined level of flexibility into handle 154, so as to control the torque applied to coupling 133 by shaft 151.

Figure 16:
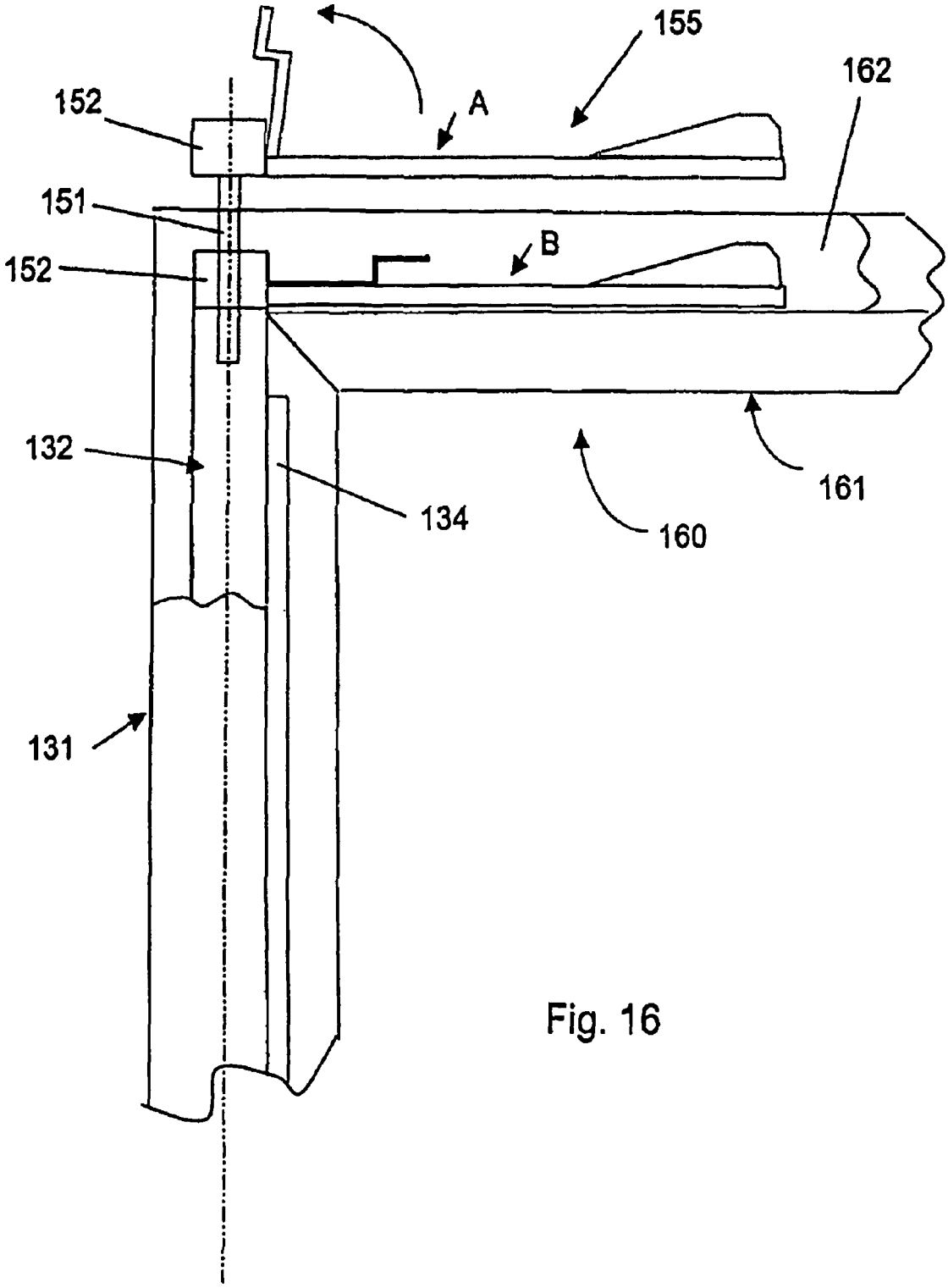
FIG. 16 is a partial elevation of the door of the second embodiment showing operation of the retainer operator and retainer.

Referring to FIG. 16, top rail 161 of door 160 is provided with channel 162, into which operator 155 fits. Prior to installation of the window unit, operator 155 is pulled upward, to the top position, shown as position A. Operator 155 is rotated to place spur 134 in the retracted position shown in FIG. 13. Installation of the window unit in door 160 then begins with fitting the first edge of the window unit into the first edge holder of the door and rotating the unit about its first edge into engagement with primary lineal 131. Handle 155 is then rotated to place spur 134 in the retained position, shown in FIG. 14. Operator 155 is then pushed down into channel 162, and the door is ready for use. It will be noted that coupling shaft 151 is of sufficient length to allow operator 155 to be lifted out of channel 162 without loss of engagement with coupling 133. The orientation of coupling shaft 151 relative to handle 155, along with the elastic properties of torque control head 152 and handle 154, assure that the torque applied to retainer 132 when in the retaining position is in a range sufficient to adequately hold the window in place adequately, yet not so great as to cause damage. Removal of the window unit is the reverse of installation.

It will appreciated that other mechanisms for rotating retainer 132 are also possible. For example, gear trains connected to a latch assembly can be used. More particularly, latch mechanism 800 can be adapted to operate a rotating retainer by replacing lock bar coupling 814 with a gear rack. The gear rack would operate a pinion connected to a suitable gear train, ultimately connecting to rotating retainer 132, to operate it in a manner that would appear to the user to be equivalent to that of the sliding lock bar mechanism. Other linkages, levers, and gear mechanisms, which may be adapted to provide improved ergonomics, esthetic appeal, or manufacturability, may also be incorporated into a rotating retainer operating mechanism.

In yet other embodiments, a lock bar can be provided that would undergo translational movement in the horizontal direction, moving retainers toward or away from a window unit during retaining and releasing the window unit. Horizontal translational movement can be provided, for example, by replacing lock bar coupling 814 with a wedge, with a wedge follower riding on the wedge and linked to a horizontally translating retainer bar. The glazing unit frame can then be provided with channels or other receiving features to receive portions of the retainer bar as it translated horizontally into position during the window unit installation process. Other linkages for moving the lock bar toward or away from the edge of the window unit are also possible.

The invention has been disclosed and described in terms of preferred embodiments and methodologies considered by the inventors to be the best mode of carrying out the invention. However, a wide variety of additions, deletions, and modifications to the disclosed embodiments might be envisioned and implemented by skilled artisans without departing from the spirit and scope of the invention as set forth in the claims.

We claim:

1. A door comprising:

a frame defining an opening partially bounded by a first side of the frame and a second side of the frame opposing the first side of the frame, the first side of the frame being formed with a first channel that faces the second side of the frame and a first sealing surface facing away from the frame, and the second side of the frame being formed with a second channel that faces the first side of the frame and a second sealing surface facing away from the frame;

a latch assembly mounted within the frame and having a projecting handle for selective manual operation of the latch assembly;

a snugger mounted in the first channel of the first side of the frame and projecting therefrom toward the second side of the frame;

a window unit having a first edge portion and a second edge portion opposite the first edge portion, the window unit being received within the opening of the frame with the first and second edge portions of the window unit being located adjacent the first and second sealing surfaces respectively;

a snugger gap extending at least partially along the first edge portion of the window unit, the snugger being disposed in the snugger gap with the snugger urging the first edge portion of the window unit toward the first sealing surface;

the window unit including a frame member extending at least partially along the second edge portion of the window unit;

a lock bar mounted in the second channel and extending at least partially along the second side of the frame;

at least one lock pin projecting from the lock bar and being captured within the frame member to retain the window unit within the opening;

the lock bar being operatively coupled to the latch assembly such that movement of the handle of the latch assembly in a first predetermined direction moves the lock bar to a position in which the lock pin is released from the frame member enabling the window unit to be removed from the opening; and movement of the handle in a second predetermined direction unlatches the door.

2. A door as claimed in claim 1 wherein the snugger is resilient and bears against the snugger gap to urge the first edge portion of the window unit toward the first sealing surface.

3. A door as claimed in claim 1 and further comprising a gasket mounted on the first and second edge portions of the window unit and being positioned to bear against the first and second sealing surfaces to form a seal.

4. A door as claimed in claim 1 wherein the first predetermined direction is upwardly.

5. A door as claimed in claim 4 wherein the second predetermined direction is downwardly.

6. A door as claimed in claim 1 further comprising a plurality of lock pins projecting from the lock bar.

7. A door as claimed in claim 1 wherein the frame member is formed with at least one installation notch therealong and when the lock bar is in said position the lock pin is aligned with the installation notch of the frame member thereby enabling the window unit to be removed from the opening.

8. A door as claimed in claim 7 wherein the lock bar and the lock pin are movable in a direction along a longitudinal axis of the second channel.

9. A door as claimed in claim 1 wherein the movement of the handle of the latch assembly in the first predetermined direction rotates the lock bar.

10. A door as claimed in claim 1 wherein the at least one lock pin comprises a plurality of lock pins located a predetermined positions along the lock bar.

* * * * *